US005894658A

United States Patent [19]

Schollenberger

[11] Patent Number: 5,894,658

[45] Date of Patent: Apr. 20, 1999

[54] TERMINAL APPLICATOR HAVING RAM RETENTION FEATURE

[75] Inventor: Marlin Robert Schollenberger, Myerstown, Pa.

[73] Assignee: The Whitaker Corporation, Wilmington, Del.

[21] Appl. No.: 08/903,637

[22] Filed: Jul. 31, 1997

[51] Int. Cl.[6] ..... H01R 43/04

[52] U.S. Cl. ..... 29/753; 29/33 M; 29/751; 72/409.06; 72/413; 72/446

[58] Field of Search ..... 29/33 M, 751, 29/753, 755, 861, 863; 72/409.06, 409.14, 413, 712, 441, 446

[56] References Cited

U.S. PATENT DOCUMENTS

| | | | |
|---|---|---|---|
| 3,184,950 | 5/1965 | Sitz | 72/331 |
| 3,911,717 | 10/1975 | Yuda | 29/753 X |
| 4,790,173 | 12/1988 | Boutcher, Jr. | 29/753 X |
| 5,228,326 | 7/1993 | Wasilko et al. | 29/753 X |
| 5,289,713 | 3/1994 | Schafer | 29/753 X |
| 5,323,634 | 6/1994 | Wolfe et al. | 29/753 X |
| 5,483,739 | 1/1996 | Smith et al. | 29/753 |
| 5,517,749 | 5/1996 | Zuin | 29/33 M X |
| 5,774,977 | 7/1998 | Folk et al. | 29/753 |

*Primary Examiner*—Peter Vo
*Assistant Examiner*—Rick Kiltae Chang
*Attorney, Agent, or Firm*—Anton P. Ness; Bruce J. Wolstoncroft

[57] ABSTRACT

An applicator (10) for crimping electrical terminals onto conductors is provided with a ram (16) having outer facing surfaces (28, 42, 44, 46) that are unobstructed by the slide (32, 34) coupling the ram to the applicator frame (12). A ram retention device is provided that includes a retention screw (50) extending through the ram (16) and into the slide coupling for engagement with a shoulder (64) to limit movement of the ram (16) and to hold it captive to the frame (12).

11 Claims, 3 Drawing Sheets

TERMINAL APPLICATOR HAVING RAM RETENTION FEATURE

The present invention relates to applicators for attaching electrical terminals to conductors and more particularly to such applicators having an open ram and a device for holding the open ram captive to the applicator.

BACKGROUND OF THE INVENTION

Applicators for attaching terminals to electrical conductors are generally received in a larger press or power unit that provides the power and physical motion to actuate the applicator and effect the crimping operation. These applicators include a ram that is guided within an opening in a ram housing and arranged to undergo reciprocating motion along a ram axis. The ram housing is an integral part of a frame and includes a base portion having a crimping anvil attached thereto that mates with upper crimping tooling mounted to the ram. The ram housing and frame are typically cast as a single integral part. A terminal feed mechanism operated by the reciprocating ram is attached to the frame so that it can engage a strip of terminals being fed from a reel and feed them into the crimping station of the applicator in timed relation to movement of the ram. Examples of such an applicator are disclosed in U.S. Pat. Nos. 3,184,950 which issued May 25, 1965 to Sitz and 5,483,739 which issued Jan. 16, 1996 to Smith et al. Both of these patents disclose applicators having closed ram structures wherein the ram housings completely encircle their respective rams when viewed along the ram's axis. That is, each ram housing has a rectangular opening formed by four walls and the ram has four outer walls in sliding engagement with the four walls of the opening. The upper crimping tooling is mounted to one of the outer walls of the ram but necessarily leaving a portion of the outer wall exposed on either side for engagement with the respective wall of the opening. A corresponding groove is formed in the opening wall opposite the tooling to provide clearance. There are several known disadvantages of this closed ram structure such as difficulty in changing the upper crimping tooling and difficulty is accessing the ram for attachment of actuating mechanisms for operating the terminal feed unit or other features such as an insulation stripper. To alleviate these problems, an applicator structure has been developed that leaves several outer surfaces of the ram exposed for more ready access. See, for example, U.S. Pat. No. 5,774,977 , which discloses an applicator having an open ram structure. Since these open rams are very accessible, they are occasionally grasped when manually handling the applicator. Typically, these rams are not held captive to the applicator thereby increasing the likelihood that the applicator will be dropped when it is manually moved by grasping the ram.

What is needed is an applicator with an open ram structure having a device for retaining the ram captive to the applicator frame, yet is easily accessible by the operator for disabling so that the ram can be removed when desired.

SUMMARY OF THE INVENTION

An applicator having an open ram is provided for attaching terminals to electrical conductors. The applicator includes a frame, a tool mounting surface attached to the frame and adapted to receive lower termination tooling, an open ram coupled to the frame and arranged for reciprocating movement along a ram axis in a first direction toward the mounting surface and in a second opposite direction. The ram is adapted to receive upper terminating tooling for mating with the lower terminating tooling for effecting the attaching of the terminals. A first slide portion is attached to the frame and a second slide portion is attached to the ram, wherein the first and second slide portions are mated in sliding engagement for guiding the ram along the ram axis. Retention means is provided for limiting the movement of the ram in the second direction to a predetermined limit so that the ram is held captive to the frame. The retention means includes a shoulder attached to the frame and a projection extending from the ram arranged to interferingly engage the shoulder when the ram reaches the predetermined limit.

DESCRIPTION OF THE PREFERRED EMBODIMENT

Figure 1:
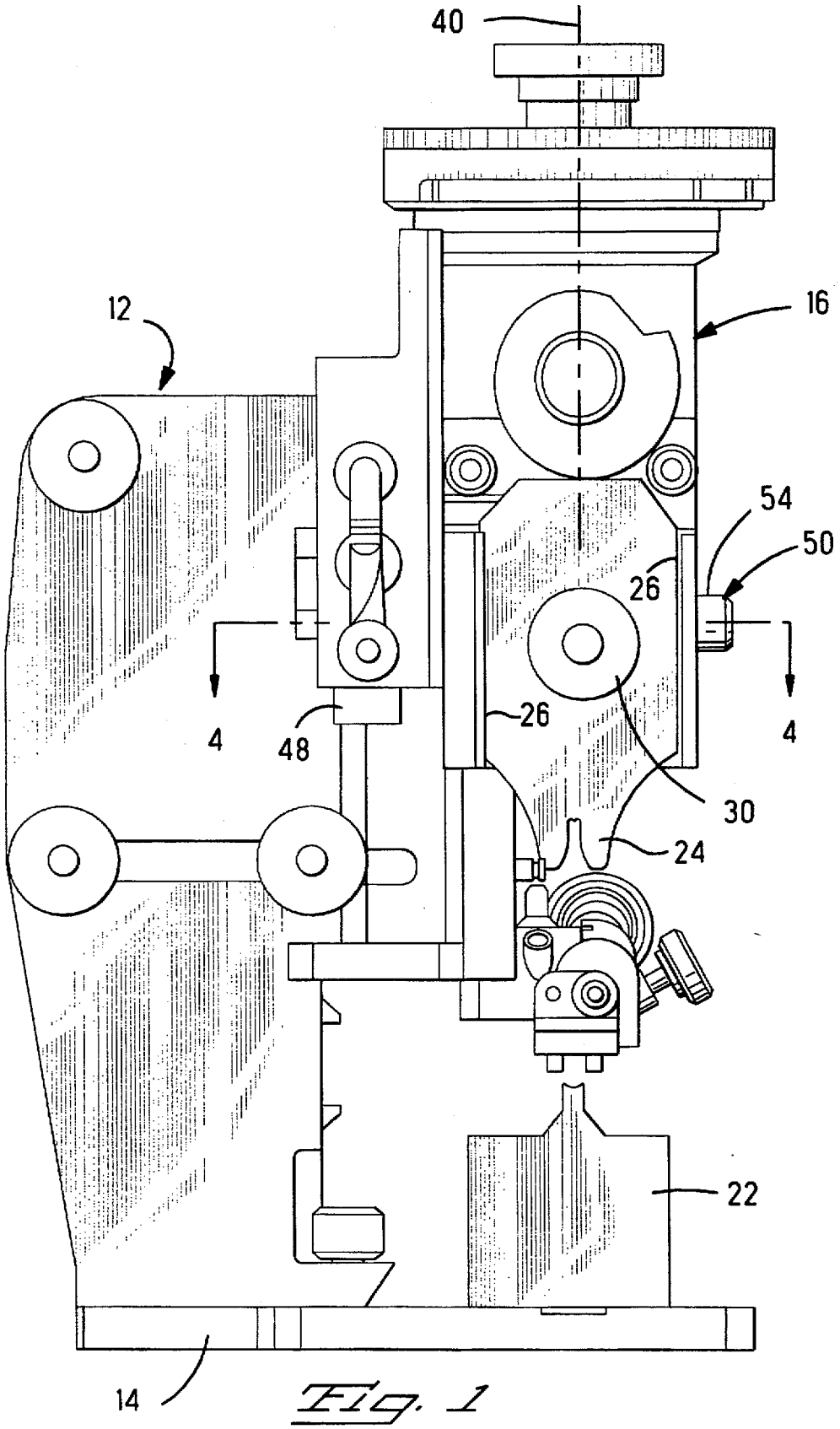
FIG. 1 is a front view of a terminal applicator incorporating the teachings of the present invention.
Figure 2:
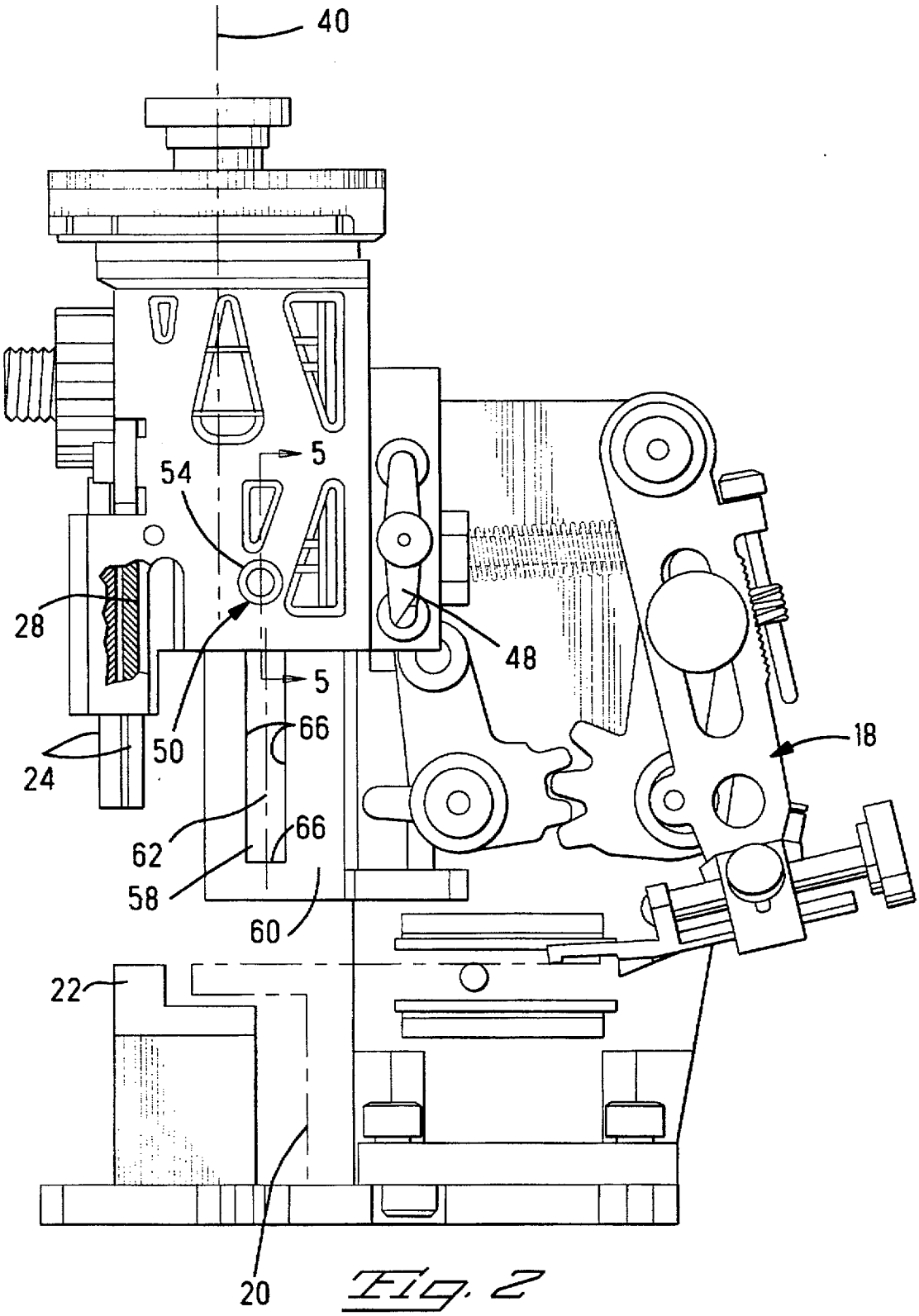
FIG. 2 is a side view of the terminal applicator shown in FIG. 1.
Figure 4:
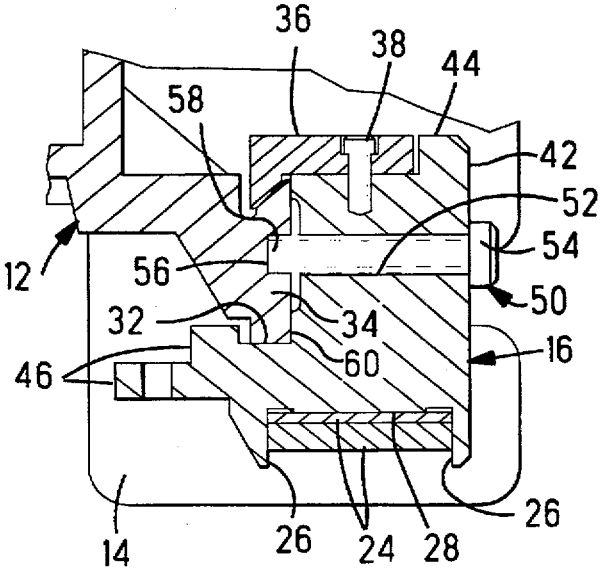
FIG. 4 is a cross-sectional view taken along the lines 4—4 in FIG. 1.

There is shown in FIGS. 1 and 2 a terminal applicator 10 having a frame 12, including a base 14, and a ram 16 arranged to undergo reciprocating motion in a first direction toward the base and in a second opposite direction. A terminal feed unit 18 is coupled to the frame and driven by the reciprocating ram to feed a strip of terminals, not shown, along a feed track 20, shown in phantom lines in FIG. 2, to lower crimping tooling 22 that is secured to the base 14 in the usual manner. Upper crimping tooling 24 is attached to and carried by the ram 16, the upper tooling being located between a pair of opposing walls 26 extending from an outer surface 28 of the ram 16. The upper tooling 24 is held in position against the surface 28 by means of a button head screw 30 in the usual manner. The ram 16 has a T-shaped opening 32 for slidingly receiving a similarly shaped way 34 that is attached to or formed integral with the frame 12, as best seen in FIG. 4. The opening 32 and way 34 form mating slide portions. One side of the opening 32 is formed by a gib 36 that is secured to the ram 16 by means of screws 38. The opening 32 and way 34 are sized so that the ram is free to slide along a ram axis 40 without appreciable lateral play. With this arrangement, most of the outer facing surfaces 28, 42, 44, and 46, when viewed axially as shown in FIG. 4, are unconfined and easily accessible for mounting support devices such as a cam 48, shown in FIGS. 1 and 2, for driving the feed unit 18 or other power takeoff devices to drive other attachments, such as a wire stripping unit, not shown. Since the ram 16 is an open ram, that is it is relatively unconfined by the mating slide portion coupling it to the frame 12, it is easily accessible for grasping when manually lifting the applicator 10 in its normal day to day use.

Figure 3:
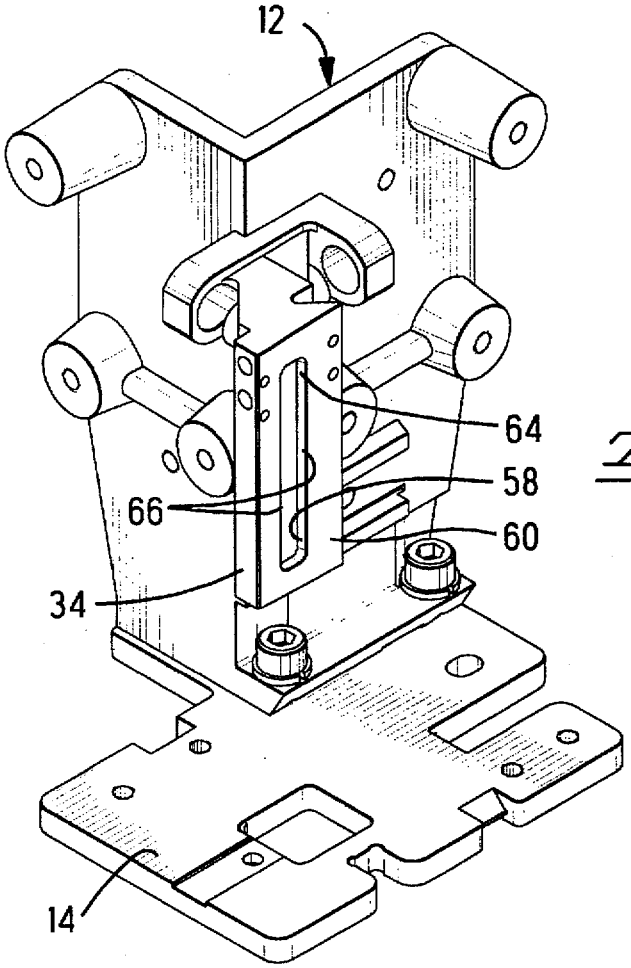
FIG. 3 is an isometric view of the applicator frame shown in FIG. 1.
Figure 5:
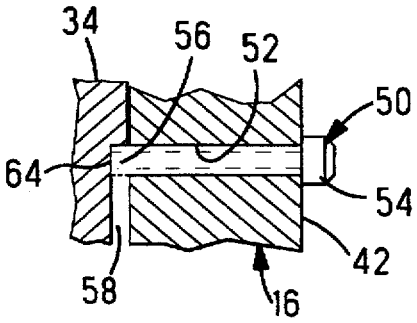
FIG. 5 is a cross-sectional view taken along the lines 5—5 in FIG. 2.

To prevent inadvertent separation of the ram from the frame, in these cases, a ram retention rod 50, which is a screw in the present example, is threaded into a threaded hole 52 formed in the ram 16 so that the hole intersects both the T-shaped opening 32 and one of the outer surfaces of the ram, preferably an outer surface that forms an angle to the surface 28, such as the outer surface 42. Note that the outer surface 42 is formed at about a 90 degree angle to the outer surface 28, against which the upper crimping tooling is secured. This provides easy access to the head 54 of the retaining screw 50 by an operator for removal or installation of the ram, as desired. The end of the screw 50 extends into an elongated opening 58 formed in a face 60 of the way 34. The elongated opening 58 has encircling walls 66 and a longitudinal axis 62 that is substantially parallel to the ram axis 40. The upper end of the encircling walls 66 forms a shoulder 64, as best seen in FIGS. 3 and 5. As the ram 16 reciprocates through its normal stroke of operation starting from its full up position, shown in FIG. 1, to its full down position, not shown, where the upper and lower tooling 24 and 22 are in mated crimping engagement, the rod 56 traverses along the longitudinal axis 62 within the elongated opening 58. In the event that the ram is moved in the second direction upwardly, as viewed in FIG. 1, past its full up position, the rod 56 engages and abuts against the shoulder 64 thereby preventing further upward movement of the ram. This effectively prevents inadvertent separation of the ram 16 from the frame 12. In the event that it is desired to separate the ram from the frame, the screw 50 is simply rotated counterclockwise until the rod 56 is clear of the shoulder 64 of the elongated opening 58. The ram 16 is then free to move upwardly and out of engagement with the way 34.

The ram retention screw 50 and shoulder 64 may take other forms in that the shoulder may be formed in an inner surface of the T-shaped opening 32 of the ram and the retention screw 50 may be threaded into a hole formed in the way 34. Additionally, the shoulder may be simply a projection that is not part of an elongated opening.

An important advantage of the present invention is that the applicator has the benefits of an open ram structure while retaining the ram captive to the applicator frame. Further the retaining device is easily accessible by the operator for disabling so that the ram can be removed when desired.

I claim:

1. An applicator operable for attaching electrical terminals to electrical conductors, said applicator having a frame, a tool mounting base attached to said frame for receiving lower termination tooling, a ram coupled to said frame by first and second slide portions and arranged for reciprocating movement along a ram axis in a first direction toward said base and in a second opposite direction, said ram for receiving upper terminating tooling for mating with said lower terminating tooling for effecting said attaching of said terminals, wherein said first slide portion is attached to said frame and said second slide portion is attached to said ram, said first and second slide portions in mated sliding engagement for guiding said ram along said ram axis during said reciprocating motion, and retention means for limiting said movement of said ram in said second direction to a predetermined limit so that said ram is held captive to said frame, said retention means comprising a shoulder attached to one of said frame and said ram, and a projection extending from the other of said frame and said ram arranged to interferingly engage said shoulder when said ram reaches said predetermined limit frame, wherein said frame includes an elongated opening having encircling walls and having a longitudinal axis that is parallel to said ram axis, and wherein said shoulder is one of said walls of said elongated opening.

2. The applicator according to claim 1 wherein said second slide portion is an opening in said ram and said first slide portion is a T-shaped member in said sliding engagement with said opening.

3. The applicator according to claim 1 wherein said projection is a rod having a threaded portion in threaded engagement with a threaded hole in said ram, said rod extending into said elongated opening.

4. The applicator according to claim 3 wherein said ram has at least first and second outer surfaces mutually angled with respect to each other and arranged to be open and unobstructed by both said first and second slide portions, said ram axis substantially parallel to said first and second surfaces, said first surface for receiving upper tooling for mating with said lower tooling for effecting said attaching of said terminals to electrical conductors, and wherein said threaded hole in said ram intersects said second surface.

5. The applicator according to claim 4 wherein said threaded hole in said ram is substantially perpendicular to said second surface.

6. An applicator operable for attaching terminals to electrical conductors, said applicator having a frame, a tool mounting base attached to said frame for receiving lower termination tooling, a ram slidingly coupled to said frame by means of first and second mating slide portions and arranged for reciprocating movement along a ram axis in a first direction toward said base and in a second opposite direction, said ram having first and second opposite ends and at least a first outer surface extending between said first and second ends, said ram axis being parallel to said first outer surface and intersecting said first and second ends, said first outer surface adjacent said first end of said ram for receiving upper tooling for mating with said lower tooling for effecting said attaching of said terminals to electrical conductors, said ram arranged so that said first outer surface is open and unobstructed by both said first and second slide portions, including retention means for limiting said movement of said ram in said second direction to a predetermined limit so that said ram is held captive to said frame, said retention means comprising a shoulder attached to one of said frame and said ram, and a projection extending from the other of said frame and said ram arranged to interferingly engage said shoulder when said ram reaches said predetermined limit, wherein said frame includes an elongated opening having encircling walls and having a longitudinal axis that is parallel to said ram axis, and wherein said shoulder is one of said walls of said elongated opening.

7. The applicator according to claim 6 wherein said second slide portion is an opening formed in said ram and said first slide portion is a T-shaped member attached to said frame in sliding engagement with said opening.

8. The applicator according to claim 7 wherein said at least a first outer surface comprises first and second outer surfaces, both of which are open and unobstructed by both said first and second slide portions.

9. The applicator according to claim 6 wherein said projection is a rod having a threaded portion in threaded engagement with a threaded hole in said ram, said rod extending into said elongated opening.

10. The applicator according to claim 9 wherein said first and second outer surfaces are mutually angled with respect to each other, said ram axis being substantially parallel to said first and second outer surfaces, and wherein said threaded hole in said ram intersects said second outer surface.

11. The applicator according to claim 10 wherein said threaded hole in said ram is substantially perpendicular to said second outer surface.

* * * * *